United States Patent [19]

Katernberg et al.

[11] Patent Number: 4,691,656

[45] Date of Patent: Sep. 8, 1987

[54] FLOATING DOCK CONSTRUCTION

[75] Inventors: Helmut Katernberg, Oberhausen; Ingolf Köhler, Wesel-Blumenkamp, both of Fed. Rep. of Germany

[73] Assignee: M.A.N.Maschinenfabrik Augsburg-Nurnberg, Fed. Rep. of Germany

[21] Appl. No.: 808,898

[22] Filed: Dec. 13, 1985

[30] Foreign Application Priority Data

Dec. 17, 1984 [DE] Fed. Rep. of Germany ... 8436853[U]

[51] Int. Cl.[4] ..... B63C 1/02

[52] U.S. Cl. ..... 114/45

[58] Field of Search ..... 114/44–49, 114/123

[56] References Cited

FOREIGN PATENT DOCUMENTS 1018138 1/1966 United Kingdom ..... 114/45

1020307 5/1983 U.S.S.R. ..... 114/45

*Primary Examiner*—Joseph F. Peters, Jr.

*Assistant Examiner*—Jesûs D. Sotelo

*Attorney, Agent, or Firm*—McGlew and Tuttle

[57] ABSTRACT

A floating dock comprises a base portion forming a floating pontoon and side portions made up of closed side boxes or tanks located on each side of said base and including detachable buoyancy boxes carried on the exterior of said side portions.

1 Claim, 5 Drawing Figures

FLOATING DOCK CONSTRUCTION

FIELD AND BACKGROUND OF THE INVENTION

The invention relates in general to slip and boat docks and in particular to a new and useful floating dock having side boxes on both the port and starboard sides.

Floating docks, in particualr those used for docking ships of the U.S. Naval forces must now meet the more stringent requirements of the Military Standard MIL-STD 1625 N (SH). The freeboards and stability criteria of floating docks specified in these safety regulations require, especially in the case of damages, special design measurements for the dock design. For instance, a widening of the side box walls in the area between the upper and the safety decks of the dock is specified, among other things.

Normally, such a widening of the side box walls presents no design problems for new dock construction. It is difficult if the dock must pass under bridges or through locks while being transported by water and the width dimensions of the dock exceed the permissible transport dimensions. By the same token, retrofitting existing floating docks to meet the specified widening of the side boxes requires special considerations.

SUMMARY OF THE INVENTION

According to the invention, detachable buoyancy boxes are provided on the outside of the floating dock side boxes between the upper deck and a safety deck.

There are various possibilities for the attachment of the buoyance boxes. One suggestion is to hook the buoyancy boxes into holders on the side boxes and to lock them by means of bolts.

It is unnecessary to equip the two side boxes of a floating dock on the outside with gaplessly adjacent buoyancy boxes from one end of the dock to the other. It suffices in some cases if some buoyancy boxes, possible of greater volume, are disposed on the outside of both side boxes at the dock ends. Even though the buoyancy boxes should preferably be attached between the upper deck and the safety deck, they can also be attached higher or lower, of course.

For a floating deck of 165 m overall length and 150 m side box length one will provide ten buoyancy boxes per side box, for example, depending on the dock crane capacity. Each buoyancy box then is approximately 15 m long and may be e.g., 8 m high and about 4 m wide. These are, of course, sizes suggested as examples only.

The buoyancy boxes disposed on the side boxes may be empty inside. But, like the side boxes themselves, they are also suited to accommodate machinery and electrical equipment. They can thus also be utilized as shop, living quarters, storage or similar spaces in the manner of containers.

Accordingly it is an object of the invention to provide a floating dock which includes closed tanks forming a base portion and a side portion on each side extending upwardly from the base portion and including a buoyancy box secured to each side portion on the exterior thereof.

A further object of the invention is to provide a floating dock which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and and descriptive matter in which a preferred embodiment of the invention is illustrated.

DESCRIPTION OF THE PREFERRED EMBODIMENTS

Figure 2:
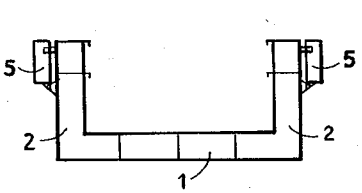
FIG. 2 is a transverse section of the dock shown in FIG. 1.

Referring to the drawings in particular, the invention embodied therein comprises a floating dock which includes a base portion 1 and side portions 2 extending upwardly on each side of said base portion, all of which are advantageously made of individual boxes or tanks 2. In accordance with the invention, a detachable buoyancy box 5 is disposed on the outside of each side box or side wall advantageously between an upper deck 3 and a safety deck 4, one deck below the upper deck.

Figure 1:
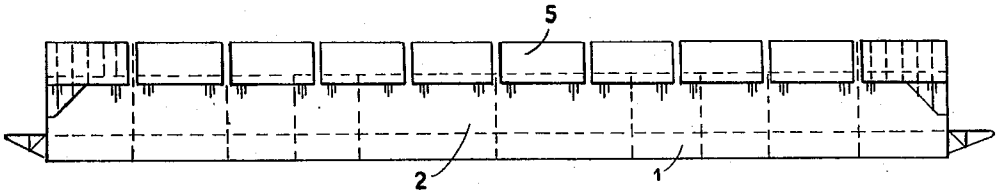
FIG. 1 is a side elevational view of a floating dock constructed in accordance with the invention.
Figure 3:
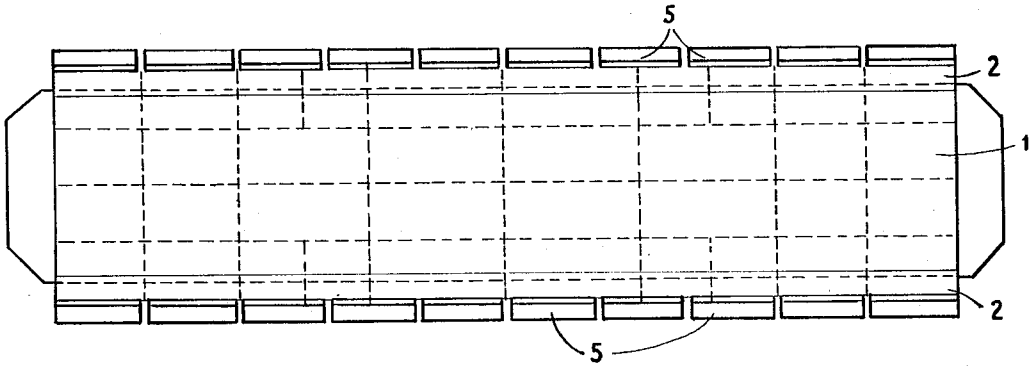
FIG. 3 is a top view of the floating dock.
Figure 4:
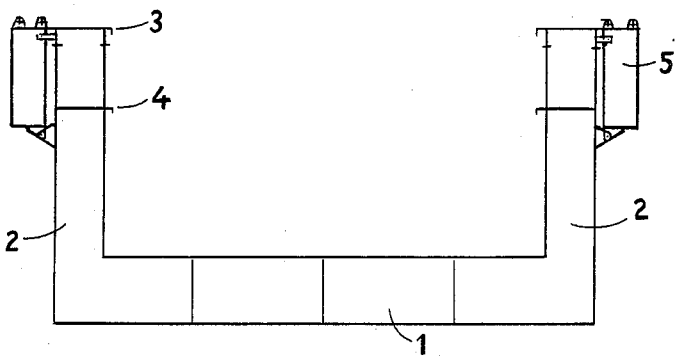
FIG. 4 is a section in larger scale.

FIGS. 1 through 3 show a floating dock with the pontoon base 1 divided into watertight compartments, and having side boxes 2 on the starboard and port sides. The upper deck is designated 3 and the safety deck 4.

Figure 5:
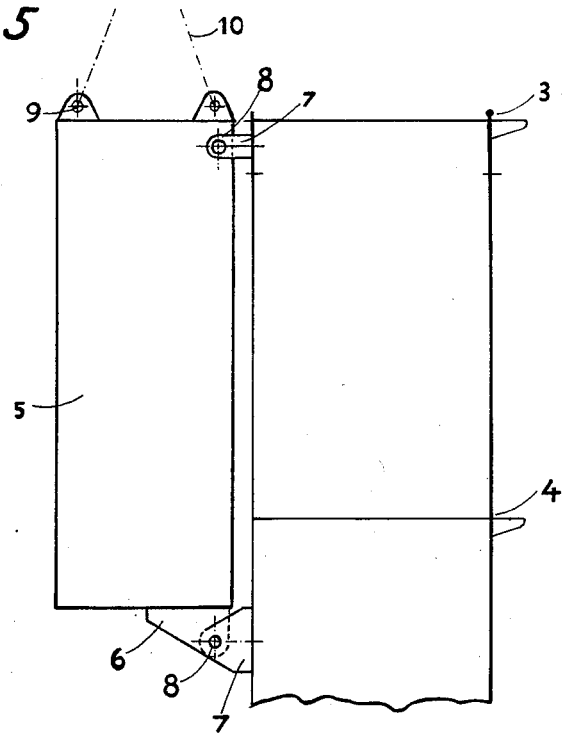
FIG. 5 is a sectional view which shows the attachment of a buoyancy box.

In accordance with the invention, disposed on the outside walls of the side boxes 2 are buoyancy boxes 5. The mode of attaching the buoyancy boxes 5 may be seen in FIGS. 5 and 5. Each buoyancy box 5 is detachably mounted to the side boxes 2 on top and bottom on both sides. This can be done, for example, in that eyes 6,7 are welded to the side boxes as well as to the bottom of buoyancy boxes. Bolts 8 lock the buoyancy boxes to the side boxes. To fasten the top of the buoyancy box, eyes 7 are also welded to the side box there. Locking in place is accomplished by means of pins 8 introduced into holes in the buoyancy boxes.

Eyes 9 to accommodate the hauling ropes 10 of the dock crane (not shown) are mounted on the top of the buoyancy boxes 5.

Before the floating dock is transported to its berth, the buoyancy boxes can be lifted off the floating dock after unlocking the locks and placed on the pontoon base to make unhindered passage under bridges and through locks possible.

Advantageously, the buoyancy boxes 5 can also be used as a work platform for maintenance work on the outer side box wall. For this purpose, the buoyancy box is hooked to the dock crane and the upper lock of the buoyancy box to the side box is unlocked so that the buoyancy box then flips outwardly, with the lower lock acting as hinge.

While a specific embodiment of the invention has been shown and described in detail to illustrate the applicaion of the principles of the invention, it will be understood that the invention may be embodied otherwise without departing from such principles.

What is claimed is:

1. A floating dock, comprising a pontoon base, a side wall made up of individual closed portion extending upwardly from each side of said base, and a plurality of detachable buoyancy containers disposed on the outside of each side wall, said side walls including substantially rectangular tank portions terminating in an upper deck at each top and a deck spaced below each upper deck defining a safety deck, said detachable buoyancy container each comprising a box secured to said side walls between said upper deck and said safety deck, upper and lower eyelets fixed to each side wall for each buoyancy container, an upper and lower eyelet fixed to each buoyancy container, said upper and lower eyelets of said container being aligned respectively with said upper and lower eyelets of one of said saide walls, and bolt elements extending through said aligned upper and lower eyelets for detachably connecting said buoyancy containers to said side walls and for permitting pivoting of said buoyancy containers on said side walls.

* * * * *